US005145431A

United States Patent [19]

Dowdeswell

[11] Patent Number: 5,145,431

[45] Date of Patent: Sep. 8, 1992

[54] AQUATIC VIEWING APPARATUS

[76] Inventor: M. Richard Dowdeswell, 356 Pimlico Rd., Greenville, S.C. 29607

[21] Appl. No.: 682,984

[22] Filed: Apr. 10, 1991

[51] Int. Cl.[5] ..... B63C 11/48

[52] U.S. Cl. ..... 441/135; 359/894

[58] Field of Search ..... 114/66; 441/135; 350/319; 2/2.1 R, 436, 437

[56] References Cited

U.S. PATENT DOCUMENTS 2,404,556 7/1946 Wirth ..... 350/319
3,619,042 11/1971 Lazar ..... 350/319
4,465,468 8/1984 Deacy ..... 114/66
4,553,819 11/1985 Correll ..... 441/135
4,936,804 6/1990 Dowdeswell ..... 441/6

*Primary Examiner*—Jesus D. Sotelo
*Attorney, Agent, or Firm*—Bailey & Hardaway

[57] ABSTRACT

A novel aquatic viewing apparatus is provided for placement on the face of a user which comprises a transparent member positioned in an annular structure of closed cell plastic foam having an inside cylindrical wall and an outside cylindrical wall connected by transverse end walls at either end thereof and the apparatus is capable of supporting the head of a user while in water.

3 Claims, 1 Drawing Sheet

AQUATIC VIEWING APPARATUS

BACKGROUND OF THE INVENTION

This invention relates generally to the art of water recreation and more specifically to the art of aquatic viewing by the use of an aquatic viewing apparatus designed for placement on the face of a wearer.

U.S. Pat. No. 4,936,804 is incorporated by reference as it discloses a non-inflatable buoyancy aid of closed cell plastic foam. Such prior patent is issued to the inventor herein.

Several varieties of an aquatic viewing apparatus exist within the prior art. An example of such equipment includes face masks such as those used in scuba diving or snorkeling. Such face masks frequently differ in structure and shape and may include attachments thereon for breathing hoses and/or a mouthpiece. Such face masks usually include some type of means for attaching the face mask to the head of a user. Another example of a type of aquatic viewing apparatus existing in the prior art is racing goggles such as those used by swimmers during swim races, however, such devices have a very limited purpose and usually cover only the eyes of a user.

While the above prior art devices function well for their intended purposes, much room exists for improvement.

SUMMARY OF THE INVENTION

It is therefore an object of this invention to provide a novel aquatic viewing apparatus for placement on the face of a user.

It is a further object of this invention to provide such a novel aquatic viewing apparatus that is buoyant and capable of supporting the head of a user while in water.

It is yet another object of this invention to provide such a novel aquatic viewing apparatus that enables a person to breath while using such an aquatic viewing apparatus.

It is still a further object of this invention to provide such a novel aquatic viewing apparatus which can be used with the floatation devices of the prior patent of the same invention to provide full body support to a user.

These as well as other objects are accomplished by an aquatic viewing apparatus comprising an annular structure of closed cell plastic foam having an open end for receiving the face of a user and a transparent member opposite the open end. The annular structure defines a breathing hole through a sidewall thereof.

DETAILED DESCRIPTION

In accordance with this invention it has been found that a novel aquatic viewing apparatus is provided for placement on the face of a user. It has also been found that the present invention provides such an aquatic viewing apparatus which is buoyant and capable of supporting the head of a user while in water. It has further been found that the present invention provides such an aquatic viewing apparatus which may also enable the user to breath while using the aquatic viewing apparatus. It has still further been found that the present invention provides such an aquatic viewing apparatus which can be used with the flotation devices of the same invention to provide full body support. The apparatus of this invention thus enables the user to experience a greater variety of aquatic sensations. Various other advantages and features will become apparent from a reading of the following description given with reference to the various figures of drawings.

Figure 1:
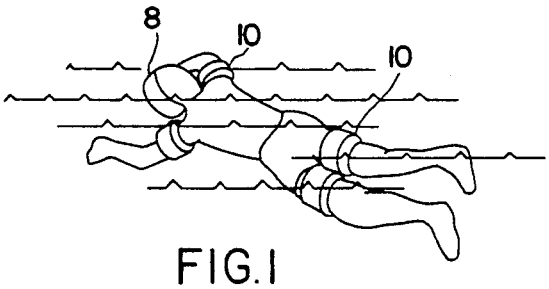
FIG. 1 of the drawings is a perspective view of the aquatic viewing apparatus on the face of a user in water.

As illustrated in FIG. 1, the aquatic viewing apparatus 8 is shown positioned over the face of a user while in water. The user is also wearing the floatation devices 10 taught by U.S. Pat. No. 4,936,804, incorporated herein by reference. The aquatic viewing apparatus 8 as shown is buoyant and supports the head of the user while in the water. Utilizing this aquatic viewing apparatus 8, the user can view underwater objects from the surface of the water or from a distance just below the surface as long as the aquatic viewing apparatus 8 does not become completely immersed.

Figure 2:
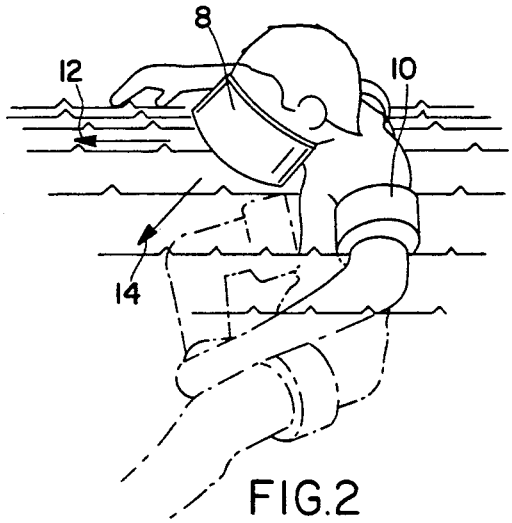
FIG. 2 is a perspective view similar to FIG. 1 illustrating the aquatic viewing apparatus being used to view both above and below the water surface.

FIG. 2 is a perspective view similar to FIG. 1 illustrating the aquatic viewing apparatus 8 being used to view both above and below the water surface, as indicated by arrows 12 and 14 respectively. Again, the aquatic viewing apparatus 8 is buoyant and supports the head of a user while in water. The user is also shown using the floatation devices 10 of the prior U.S. Patent incorporated by reference herein.

Figure 3:
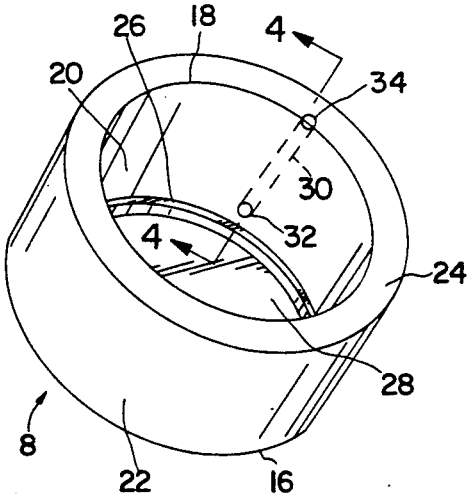
FIG. 3 is a perspective view of the aquatic viewing apparatus.

FIG. 3 of the drawings is a perspective view of the aquatic viewing apparatus 8. As shown, the aquatic viewing apparatus 8 comprises an annular structure 16 formed of closed cell plastic foam. Annular structure 16 has an open end 18 for receiving the face of a user. Annular structure 16 also has an inside cylindrical wall 20 and an outside cylindrical wall 22 generally parallel to the inside cylindrical wall 20 and displaced from it about a radius of the annular structure 16. The inside cylindrical wall 20 and outside cylindrical wall 22 are connected by transverse end walls 24 at either end of the walls 20 and 22. The transverse end walls 24 are substantially perpendicular to the inside cylindrical wall 20 and the outside cylindrical wall 22. A groove 26 is shown positioned opposite the open end 18 of the annular structure 16. Groove 26 extends annularly around the entire inside cylindrical wall 20 of the annular structure 16. The groove 26 is designed to receive a transparent member 28, partially illustrated in FIG. 3. This transparent member 28 closes of an end of the annular structure 16, enabling a user of annular structure 16 to view through the transparent member 28. It is possible for the transparent member 28 to be either fixedly positioned in groove 26, for example, by glue or some other means, or for the transparent member 28 to remain detachably positioned in groove 26.

Also illustrated in FIG. 3 is breathing hole 30 which is defined by the annular structure 16. Breathing hole 30 is defined through the annular structure 16 and has a first opening 32 communicating with the inside cylindrical wall 20 and a second opening 34, shown in phantom, communicating with the outside cylindrical wall 22. Breathing hole 30 may exist in various different positions through the annular structure 16, and it is provided to enable a user to breath while using the apparatus 8.

The aquatic viewing apparatus 8 can be used with the floatation devices 10 as taught by the prior patent of the same invention, as shown in FIG. 1. Utilizing such a feature, a person can relax his body while being supported in a floating position by the floatation devices 10 and can simultaneously relax his head while using the aquatic viewing apparatus 8 as the annular structure 16 of the apparatus supports the head of the user. The breathing hole 30 enables a person to breath while using the apparatus 8, thereby allowing the user of the aquatic viewing apparatus 8 and the floatation devices 10 to be even more relaxed.

It is thus seen that the aquatic viewing apparatus 8 of the present invention needs no extra means for attaching the apparatus 8 to the head of a user. The annular structure 16 receives the face of a user, and the annular structure 16 supports the head of the user while in the water. While being used, the aquatic viewing apparatus 8, through breathing hole 30, also enables a person to breath while using the aquatic viewing apparatus according to this invention.

Figure 4:
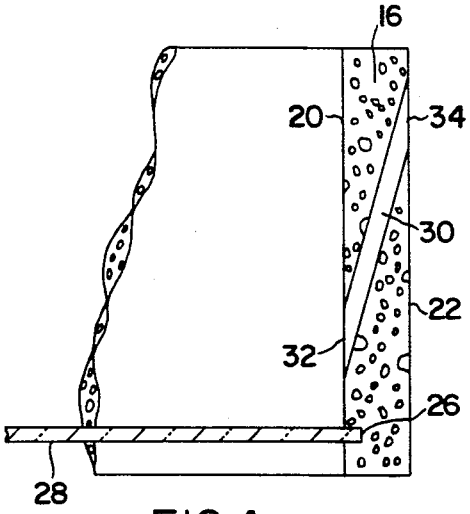
FIG. 4 is a cross section view along line 4—4 of FIG. 3.

FIG. 4 of the drawings is a cross section view taken along line 4—4 of FIG. 3 illustrating the cross section of the annular structure 16 as it defines the breathing hole 30 in a preferred embodiment. As illustrated, the breathing hole 30 is defined through the annular structure 16 and has a first opening 32 communicating with the inside cylindrical wall 20 and a second opening 34 communicating with the outside cylindrical wall 22. Groove 26 is partially shown as is the transparent member 28 as it is positioned inside and supported by groove 26. In this preferred embodiment, the hole 30 is defined diagonally through the annular structure 16, with the first opening 32 positioned proximate to the transparent member 28 and the second opening 34 positioned proximate to the opposite, open end. In this manner, the best possible positioning for the breathing hole 30 exists so as to deter water from entering through second opening 34 while simultaneously preventing the first opening 32 from being covered by the face of a user.

It is thus seen that the present invention provides a novel aquatic viewing apparatus for placement on the face of a user. It is also seen that the present invention provides a novel aquatic viewing apparatus that is buoyant and capable of supporting the head of a user while in water. It is further seen that the present invention provides a novel aquatic viewing apparatus that enables a person to breath while using the aquatic viewing apparatus. It is still further seen that the present invention provides such an aquatic viewing apparatus that can be used with the floatation devices of the same invention to provide full body support. Many variations are apparent to those of skill in the art, and such variations are embodied within the spirit and scope of the present invention as measured by the following appended claims.

That which is claimed is:

1. An aquatic viewing apparatus comprising:

an annular structure formed of closed cell plastic foam having an open end for receiving the face of a user;

said annular structure having an inside cylindrical wall and an outside cylindrical wall generally parallel to said inside cylindrical wall and displaced therefrom about a radius of said annular structure, said inside cylindrical wall and said outside cylindrical wall connected by transverse end walls at either end thereof;

said transverse end walls being substantially perpendicular to said inside cylindrical wall and said outside cylindrical wall;

said inside cylindrical wall having a groove at one end thereof opposite said open end generally proximate to one of said end walls and extending annularly around the entire inside cylindrical wall of said annular structure;

a transparent member in said groove of said inside cylindrical wall;

means in gaseous communication between said inside and said outside walls to supply air to the user;

said apparatus being buoyant and capable of supporting the head of a user while in water.

2. An aquatic viewing apparatus comprising:

an annular structure formed of closed cell plastic foam having an open end for receiving the face of a user;

said annular structure having an inside cylindrical wall and an outside cylindrical wall generally parallel to said inside cylindrical wall and displaced therefrom about a radius of said annular structure, said inside cylindrical wall and said outside cylindrical wall connected by transverse end walls at either end thereof;

said transverse end walls being substantially perpendicular to said inside cylindrical wall and said outside cylindrical wall;

said annular structure defining a hole therethrough with a first opening communicating with said inside cylindrical wall and a second opening communicating with said outside cylindrical wall;

said inside cylindrical wall having a groove at one end thereof opposite said open end generally proximate to one of said end walls and extending annularly around the entire inside cylindrical wall of said annular structure;

a transparent member in said groove of said inside cylindrical wall; and said apparatus being buoyant and capable of supporting the head of a user while in water.

3. An aquatic viewing apparatus comprising:

an annular structure formed of closed cell plastic foam having an open end for receiving the face of a user;

said annular structure having an inside cylindrical wall and an outside cylindrical wall generally parallel to said inside cylindrical wall and displaced therefrom about a radius of said annular structure, said inside cylindrical wall and said outside cylindrical wall connected by transverse end walls at either end thereof;

said transverse end walls being substantially perpendicular to said inside cylindrical wall and said outside cylindrical wall;

said annular structure defining a hole diagonally therethrough, with a first opening communicating with said inside cylindrical wall and a second opening communicating with said outside cylindrical wall;

said inside cylindrical wall having a groove at one end thereof opposite said open end generally proximate to one of said end walls and extending annularly around the entire inside cylindrical wall of said annular structure; and a transparent member in said groove of said inside cylindrical wall;

said first opening of said hole positioned proximate to said transparent member and said second opening positioned proximate to said open end of said annular structure;

said apparatus being buoyant and capable of supporting the head of a user while in water.

* * * * *